US005568170A

United States Patent [19]

Hirano et al.

[11] Patent Number: 5,568,170

[45] Date of Patent: Oct. 22, 1996

[54] LASER RECORDING APPARATUS FOR VAPORIZING COLDER DYE ACROSS A GAP, AND RECORDING METHOD THEREOF

[75] Inventors: Hideki Hirano, Kanagawa; Hidemi Tomita, Tokyo; Kenji Shinozaki, Kanagawa, all of Japan

[73] Assignee: Sony Corporation, Tokyo, Japan

[21] Appl. No.: 258,737

[22] Filed: Jun. 13, 1994

[30] Foreign Application Priority Data

Jun. 14, 1993 [JP] Japan ..... 5-168697

[51] Int. Cl.[6] ..... B41J 2/435

[52] U.S. Cl. ..... 347/51; 347/88

[58] Field of Search ..... 347/2, 51, 58, 347/88, 99, 224, 225

[56] References Cited

U.S. PATENT DOCUMENTS

| | | | |
|---|---|---|---|
| 4,531,138 | 7/1985 | Endo et al. | 347/51 |
| 4,876,235 | 10/1989 | DeBoer | 428/195 |
| 5,017,547 | 5/1991 | DeBoer . | |
| 5,021,808 | 6/1991 | Kohyama | 347/51 |
| 5,270,730 | 12/1993 | Yaegashi et al. | 347/88 |

FOREIGN PATENT DOCUMENTS

| | | |
|---|---|---|
| 0321922 | 6/1989 | European Pat. Off. . |
| 0366461 | 5/1990 | European Pat. Off. . |
| 0529889 | 3/1993 | European Pat. Off. . |
| 0608881 | 8/1994 | European Pat. Off. . |

OTHER PUBLICATIONS

Tolbert et al, "High–Speed Color Imaging by Laser Ablation Transfer with a Dynamic Release Layer: Fundamental Mechanisms", Journal of Imaging Science and Technology, vol. 37, Aug. 1993, Springfield, VA pp. 411–421.

*Primary Examiner*—Mark J. Reinhart

*Attorney, Agent, or Firm*—Hill, Steadman & Simpson

[57] ABSTRACT

The recording apparatus of the present invention comprises a recording part in which a layer of a heat-fusible recording material is formed opposite a recording medium with a gap between, the recording part being so constructed as to selectively heat said heat-fusible recording material, thereby vaporizing or ablating it, and transfer the vapor to the recording medium through the gap, the recording material containing a heat energy absorber which promotes the heating of the recording material.

15 Claims, 9 Drawing Sheets

LASER RECORDING APPARATUS FOR VAPORIZING COLDER DYE ACROSS A GAP, AND RECORDING METHOD THEREOF

BACKGROUND OF THE INVENTION

The present invention relates to a recording apparatus and a recording method, and more particularly, to a thermal recording apparatus and a thermal recording method using the apparatus.

It has recently become more popular than before to record in colors the images of video camera, television, and computer graphics. This has aroused a sudden demand for colored hard copies. To meet this demand there have been developed color printers of various types.

Among various recording systems is the thermal transfer system which employs an ink sheet and a thermal recording head. The ink sheet has an ink layer formed thereon from an adequate binder resin and a transferable dye dispersed therein in high concentrations. In printing operation, the ink sheet is pressed under certain pressure against a piece of printing paper (or any other proper medium) coated with a dyeable resin which receives the transferred dye. Dye transfer takes place as the thermal recording head on the ink sheet generates heat in response to image signals. Thus the dye is transferred from the ink sheet to the printing paper in proportion to the amount of heat.

If the above-mentioned procedure is repeated for image signals separated into subtractive primaries (i.e., yellow, magenta, and cyan), it is possible to produce a color image having a continuous gradation. The thermal transfer system is attracting attention because it provides high-quality images comparable to those of silver halide color photography, it simply needs a small-sized, easy-to-maintain machine, and it operates on the real-time basis.

FIG. 1 is a schematic front view showing the important parts of a printer of the thermal transfer system.

There are shown a thermal recording head 61 (referred to as thermal head hereinafter) and a platen roller 63, which face each other. Between them are interposed an ink sheet 62 and a sheet of recording paper (transfer medium) 70. The ink sheet 62 is composed of a base film **62*b* and an ink layer 62*a* formed thereon. The recording paper 70 is composed of paper 70*b* and a dyeable resin layer 70*a* formed thereon. They pass over the thermal head 61 under pressure exerted by the rotating platen roller 63**.

Upon selective heating by the thermal head 61, the ink (transferable dye) in the ink layer **62*a* is transferred to the dyeable resin layer 70*a* of the transfer medium 70**. In this way thermal transfer printing in dot pattern is accomplished. Thermal transfer printing of this type is usually based on the line system which employs a long thermal head which is fixed at a right angle to the direction in which the recording paper runs.

Unfortunately, the line system has the following disadvantages.

(1) The ink sheet to supply ink is thrown away once it has been used. After printing, it becomes wastes, posing a problem with material saving and environment protection.

(2) In order to reduce the amount of ink sheet thrown away, it has been proposed a means to provide full-color images by using an ink sheet repeatedly. However, this system has a disadvantage that the second and subsequent printing is poor in quality because of "back transfer". In other words, when a first transfer dye A is transferred to a transfer medium and a second transfer dye B is transferred to the same transfer medium, the transferred dye A is transferred back from the transfer medium to the layer of the transfer dye B on the ink sheet.

(3) The ink sheet is bulky, and this limits the size reduction and weight reduction of the printer.

(4) Actually, the so-called thermal transfer system utilizes the thermal transfer of a dye. For a dye to diffuse into the image receiving layer of the transfer medium, it is necessary to sufficiently heat the image receiving layer, too. This lowers the heating efficiency.

(5) For efficient transfer, it is necessary to press the ink sheet against the transfer medium under high pressure. Any printer to meet this requirement has to be strong. This again limits the size reduction and weight reduction of the printer.

Since the thermal transfer system has many disadvantages as mentioned above, it is desirable to establish a technology to reduce the amount of wastes and transfer energy and to produce a small light printer, without sacrificing the above-mentioned advantages.

Other thermal transfer recording systems proposed so far are given below.

U.S. Pat. Nos. 4,772,582 and 4,876,235 disclose a method for transfer printing by the sublimation of a disperse dye which takes place upon irradiation with a diode laser. The dye is supplied from an ink sheet which is spaced away from printing paper by plastic microspheres. However, these patents merely describe a throwaway ink sheet coated with a binder resin in which the dye is dispersed.

U.S. Pat. No. 5,017,547 also discloses a method for transfer printing by the sublimation of a disperse dye which takes place when an infrared absorbing dyestuff added to the dye layer is heated by irradiation with a diode laser. The dye is supplied from an ink sheet which is spaced away from printing paper by microspheres. This patent merely describes a throwaway ink sheet coated with a binder resin in which the dye is dispersed.

They mention spacing with microspheres but they do not mention spacing with metal film or plastic film, nor do they mention anything about efficient light-heat conversion.

U.S. Pat. No. 4,541,830 discloses a method for ordinary thermal transfer printing with an ink sheet spaced away from printing paper by microspheres. This patent merely describes a throwaway ink sheet coated with a binder resin in which the dye is dispersed.

The prior art technologies mentioned above have not yet eliminated the above-mentioned disadvantages.

SUMMARY OF THE INVENTION

Under circumstances described in the foregoing, an object of the present invention is to provide a recording apparatus and recording method assured of high-quality recording with high thermal efficiency, facilitating the size reduction and weight reduction, and freed from occurrence of wastes such as used ink sheet.

The present invention is embodied in a recording apparatus which comprises a recording part in which a layer of a heat-fusible recording material is formed opposite a recording medium with a gap between, the recording part being so constructed as to selectively heat the heat-fusible recording material, thereby vaporizing or ablating it, and transfer the vapor to the recording medium through said gap, the recording material containing a heat energy absorber which promotes the heating of the recording material.

The invention should preferably be modified such that the recording material contains uniformly dissolved therein a light-heat converting dye which, upon irradiation with light, absorbs the light of specific wavelength and heats the recording dye.

The recording apparatus should preferably have a diode laser as an energy source to selectively vaporize or ablate the recording material, and a means to continuously feed the recording medium to the recording part, the recording medium having an image receiving layer which faces, with a gap between, the layer of the recording material in the recording part.

The recording dye should preferably contain uniformly dissolved therein a light-heat converting polymeric material which has in the main chains or side chains, or at the terminals a dye segment capable of absorbing the light of specific wavelength which is irradiated to heat the recording dye. This prevents the vaporization of the dye component capable of absorbing light.

The invention may be modified such that the recording material contains a light-heat converting pigment capable of absorbing the light of specific wavelength irradiated for heating, said pigment being surface-treated for improved dispersion into the recording material.

According to the present invention, it is desirable that at least one of the light-heat converting dye, light-heat converting polymeric material, and light-heat converting pigment be in the state of uniform segregation at the interface between the layer of the recording material and the gap.

The present invention is embodied also in a recording method which comprises transferring the recording material to the recording medium by using the recording apparatus defined above.

According to the present invention, the recording material forms a layer (dye layer) in which the light-heat converter is uniformly dispersed. This offers an advantage that the average distance between the recording material (dye) and the light-heat converter is smaller than in the case where the light-heat converter is outside the dye layer or the light-heat converter is unevenly dispersed in the dye layer. The consequence is that the transfer dye rapidly attains the volatilizing temperature and the ratio of heat lost to heat supplied is lower than in the case where the average distance between the dye and the light-heat converter is long. In addition, the light-heat converter used in the present invention has an extremely low thermal conductivity as compared with metal thin film. This leads to the low thermal conductivity of the recording part as a whole.

DETAILED DESCRIPTION OF THE INVENTION

Figure 1:
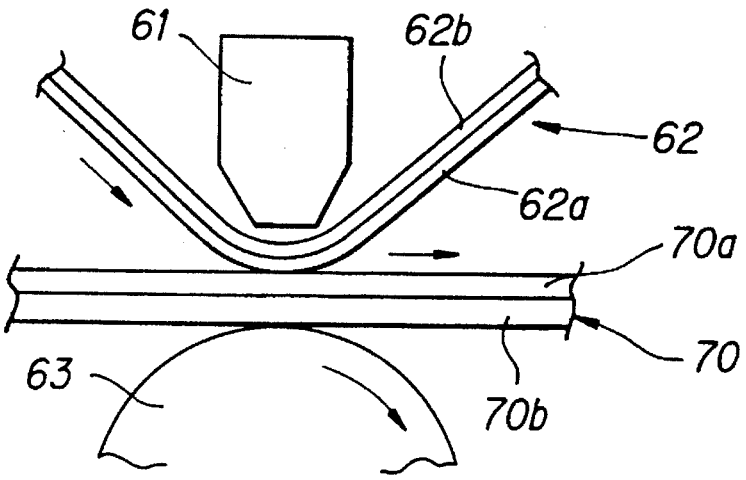
FIG. 1 is a front view of the important parts of the recording apparatus equipped with a conventional heat-sensitive recording head.

The present inventors carried out a series of researches to develop a new thermal recording system mentioned below which meets the above-mentioned requirements. As the result, they completed the present invention.

The thermal recording system consists of a recording part, a recording medium, and a heating means. The recording part has a dye layer which melts upon heating. The recording medium has an image receiving layer which accepts the dye. There is a small gap between the recording part and the recording medium. The heating means is a thermal head or laser. The heating means is intended to heat the dye on the recording part, thereby selectively vaporizing or ablating it. The vaporized or ablated dye moves across the gap and forms an image with a continuous gradation on the recording medium. This procedure is repeated in response to image signals separated into subtractive primaries (i.e., yellow, magenta, and cyan) to produce a full-color image.

According to this thermal recording system, as the dye is consumed for recording, the fresh dye is supplied in the molten state to the transfer part from the dye vessel because it contains no binder resin. Alternatively, the recording part is continuously supplied with the dye by feeding an adequate substrate coated with the dye. Therefore, the recording part can be used repeatedly in principle. This solves the above-mentioned problem (1).

In addition, the thermal recording system permits recording without the dye layer coming into contact with the recording medium. This solves the above-mentioned problem (2) associated with "back transfer" which impairs the image quality. "Back transfer" is defined as the transferring of a previously transferred dye from the recording medium to the dye layer for a dye to be transferred subsequently. In addition, the fact that the recording system uses a small dye vessel to supply the dye and hence uses no ink sheet contributes to the size reduction and weight reduction of the printer.

In addition, the recording system utilizes a dye which vaporizes or ablates and hence obviates the necessity of heating the image receiving layer of the recording medium and pressing strongly the ink sheet against the recording medium. This solves the above-mentioned problems (4) and (5). The fact that there is no direct contact between the recording part and the recording medium eliminates in principle the possibility of heat fusion between the recording part and the recording medium. Moreover, the recording system permits recording even though the dye is not sufficiently miscible with the resin of the image receiving layer. This offers a wide choice of the dye and the resin of the image receiving layer.

In the case where the heating means is a laser, it is desirable that the laser be used in combination with a material (light-heat converter) which absorbs the laser light to convert light energy into heat energy. The use of a laser beam greatly improves the resolving power. In addition, a laser beam, when concentrated by an optical system, permits intensive heating and attains a high heating temperature. This leads to a high heating efficiency. These advantages can be produced by using a semiconductor laser which is characterized by small size, high energy efficiency, high reliability, low prices, long life, high speed, low energy consumption, and easy modulation. All this leads to a high-quality image.

The light-heat converter is required to absorb the laser light and also to have good heat resistance. It may be placed either outside or inside the dye layer. The one placed outside the dye layer may be a vacuum-deposited film or a coated film. The former may be formed by vacuum-depositing cobalt or nickel-cobalt alloy on a polyimide or aramid base film (having good heat resistance and high strength) incorporated with a pigment such as carbon black and phthalocyanine. The latter may be formed by coating a base film (mentioned above) with a heat-resistant binder resin in which the pigment fine particles are dispersed.

That which functions as the light-heat converter placed inside the dye layer is a heat-resistant pigment, such as carbon black and phthalocyanine, or a dye, such as cyanine dye, which exhibits the absorption maximum in the near infrared region. This pigment or dye is dispersed in the recording dye layer.

Unfortunately, the light-heat converter placed outside the dye layer, particularly that of metal deposited type, has a disadvantage of losing a non-negligible amount of heat through the deposited film which is a good heat conductor. In addition, it dissipates a large portion of the heat it receives because the heat source is outside the dye layer. This leads to a low transfer sensitivity.

In addition, the light-heat converter placed inside the dye layer, particularly that of a pigment such as phthalocyanine or carbon black, also suffers the same disadvantage as mentioned above, because the pigment precipitates soon to form a pigment layer. In the case where the light-heat converter is a dye such as cyanine dye, it is poor in miscibility with the transfer dye and hence tends to coagulate in the transfer dye.

The present inventors found that it is possible to increase the sensitivity of laser thermal recording if a new recording part is used in place of the recording part which has the light-heat converter outside or inside the dye layer. The new recording part contains the light-heat converter uniformly dissolved and dispersed in the dye layer. The present invention is based on this finding.

The light-heat converter to be added to the dye layer is any substance which exhibits absorption at the wavelength of laser light used. It may be a dye or pigment which uniformly disperses into the dye.

The light-heat converter may be a dye which absorbs diode laser light in the near infrared region. Examples of the dye include disperse dyes, oil-soluble dyes, leuco dyes, acid dyes, cationic dyes, and direct dyes, which are any of cyanine, squarilium, croconium, phthalocyanine, naphthalocyanine, dithiol-nickel complex, naphthoquinone, anthraquinone, oxazine, indoaniline, and azo dyes. They may be modified with long chains or branched alkyl groups so as to improve their solubility or dispersibility into the recording dye.

There are several ways to cope with the situation in which the light absorbing dye transfers to the recording medium together with the recording dye at the time of recording. For example, it is desirable to use a dye which absorbs the near infrared laser light but absorbs no visible light. Such a dye does not substantially stain the recording medium even though it transfers to the recording medium. It is also desirable to use a laser-absorbing dye which is less miscible with the image-receiving layer on the recording medium. Such a dye does not readily penetrate into the image receiving layer although the recording dye does through heat diffusion. Therefore, it may be mechanically removed from the surface of the recording medium after the recording dye has been fixed. It is also desirable to use a polymeric material which has the laser-absorbing dye in its main chains or side chains or at its terminals. Such a polymeric material does not transfer upon heating and hence does not stain the recording medium.

The laser-absorbing pigment may be selected from organic pigments (such as phthalocyanine, naphthalocyanine, anthraquinone, and azo pigments) and inorganic pigments (such as carbon black, metal oxides, and metal fine powder).

A pigment (as the laser light absorber) to be added to the layer of the transfer dye should preferably be one which has a particle size smaller than 1 μm. In addition, it is desirable that the pigment be surface-treated with a polymer to enhance the dispersibility. Being almost non-volatile, such a pigment does not transfer to the recording medium at all under the ordinary conditions. Consequently, it does not stain the recording medium even though it exhibit absorption in the visible region.

The light-heat converting dye exhibits absorption at the wavelength of laser light. The light-heat converting pigment may be a polymeric substance which has in the main chains or side chains or at the terminals a dye which exhibits absorption at the wavelength of laser light. The light-heat converting pigment may be one which is surface-treated so as to improve its dispersibility into the transfer dye. The dye or pigment mentioned above should preferably be present in the state of uniform segregation at the interface between the air (gap) and the layer of the molten dye in the recording part. The state of segregation is desirable because it minimizes the loss of heat. An example of such light-heat converters is a near infrared absorbing dye containing a surface active agent.

The laser-absorbing dye or pigment added to the layer of the dye is heated and melted at 100° C. or above in the recording part. In addition, it is heated instantaneously to 400° C. or above when irradiated with laser light. Therefore, it should have sufficient light stability and heat stability. It is important that the laser light absorber have a high molar absorptivity so as to achieve a high recording density while keeping the amount of the laser absorber low and the dye concentration in the dye layer high.

The recording dye that can be used in the present invention may be selected from any dye which has a vapor pressure higher than 1 Pa in vacuum at room temperature to the thermal decomposition temperature. Examples of such dyes include disperse dyes, oil-soluble dyes, leuco dyes, cationic dyes, acid dyes rendered oil-soluble, and cationic dyes rendered oil-soluble.

The image receiving material that can be used in the present invention may be selected from any material that accepts and fixes the recording dye. Preferred examples include polyester, polyvinyl chloride, polystyrene, cellulose ester, and polycarbonate, which have a high vapor pressure and are miscible with the dye. The miscibility of the resin (as the image receiving material) with the dye does not affect the recording sensitivity because, according to the recording system of the present invention, there is a gap between the recording part (which supplies the dye) and the recording medium. Therefore, it is possible to use as the recording medium plain paper, metal, glass, wood, ceramics, etc. which are not at all miscible with the recording dye if there is a means to fix the dye involved.

The recording system of the present invention employs as the recording dye a molten dye which contains almost no binder resin. Therefore, as the recording dye is consumed for recording, the recording part is supplied with the dye in molten state from the dye vessel. Alternatively, the recording part is continuously supplied with the dye as a substrate is continuously coated with dye and the coated substrate is moved to the recording part.

The above-mentioned prior art employs a sheet as a medium to supply the dye. In this case, microspheres are most suitable as a means to provide a gap for the flexible sheet. However, since the recording system of the present invention employs a rigid structure in place of the flexible sheet (ribbon), the microspheres may be replaced by a metal film or plastic film having a slit or hole (several millimeter wide) to provide the necessary gap.

EMBODIMENTS

Embodiments of the present invention will be described with reference to the drawings.

Figure 2:
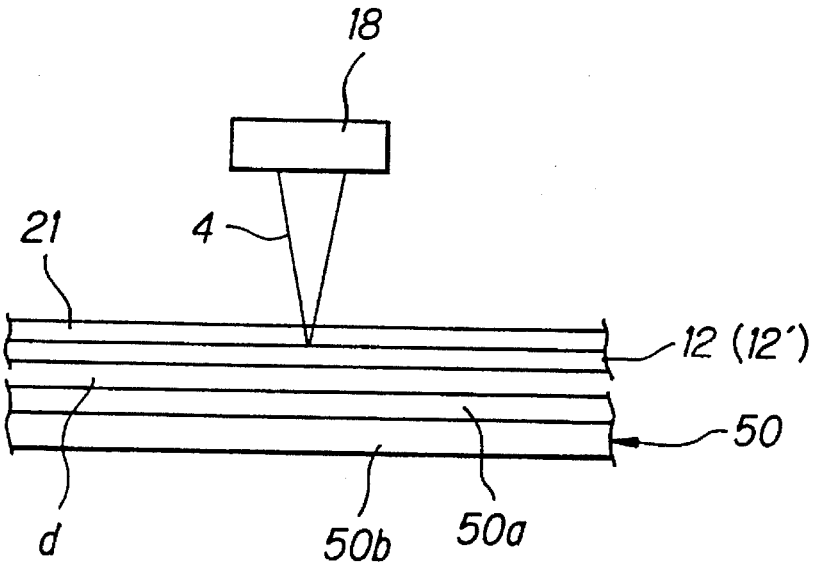
FIG. 2 is a schematic sectional view of the recording part of the recording apparatus pertaining to the example.

First, the structure of the recording part is outlined with reference to FIG. 2.

There are shown a light-heat converter 21, a semiconductor chip 18 above it, and recording paper 50 under it. The recording paper 50 is composed of a base **50*b* and an image receiving layer 50*a* formed thereon. The light-heat converter 21 and the image receiving layer 50*a*** face each other, with a gap d between. The gap d is in the range of from 10 to 100 μm, say 60 μm.

The lower side of the light-heat converter 21 is supplied with a dye 12 or a molten dye 12'. The light-heat converter 21 converts the laser light L from the semiconductor chip 18 into heat energy, thereby vaporizing (or ablating) the dye 12 or 12'. The vaporized or ablated dye moves to the image receiving layer **50*a*** across the gap d and fixes thereon. In this way recording is accomplished.

Figure 3:
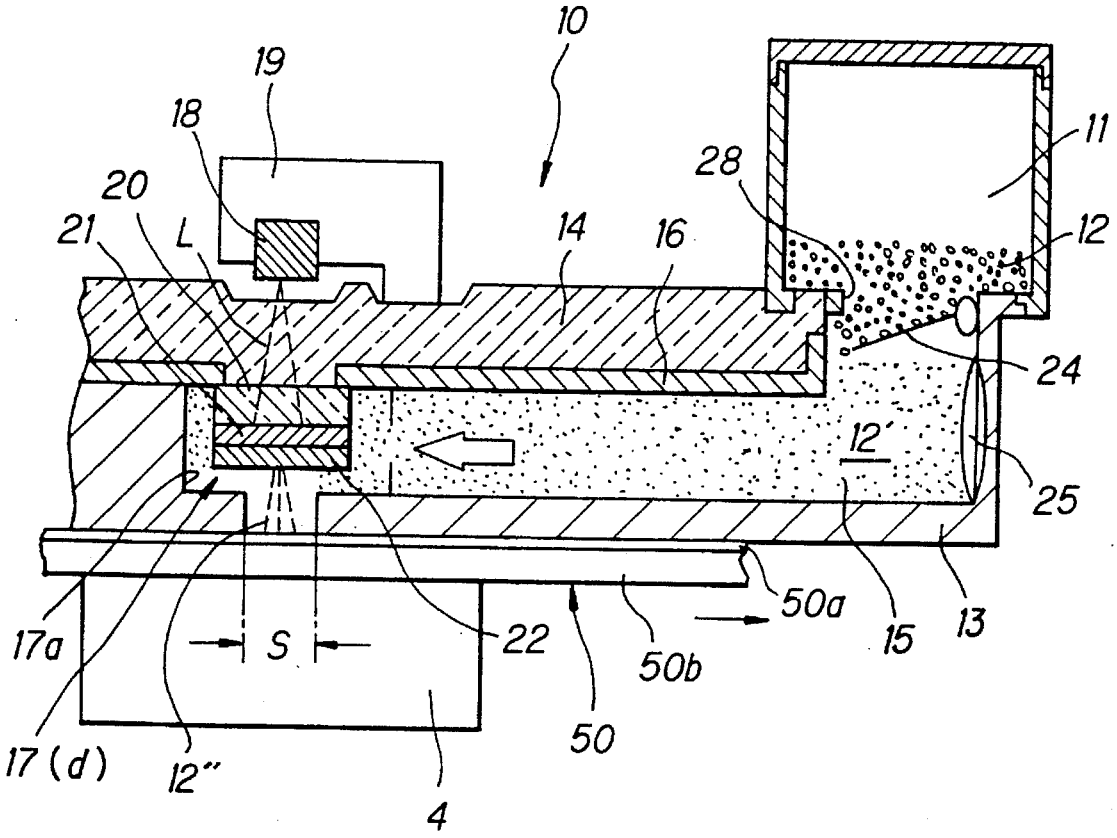
FIG. 3 is a sectional view of the recording part of the recording apparatus pertaining to the example.
Figure 4:
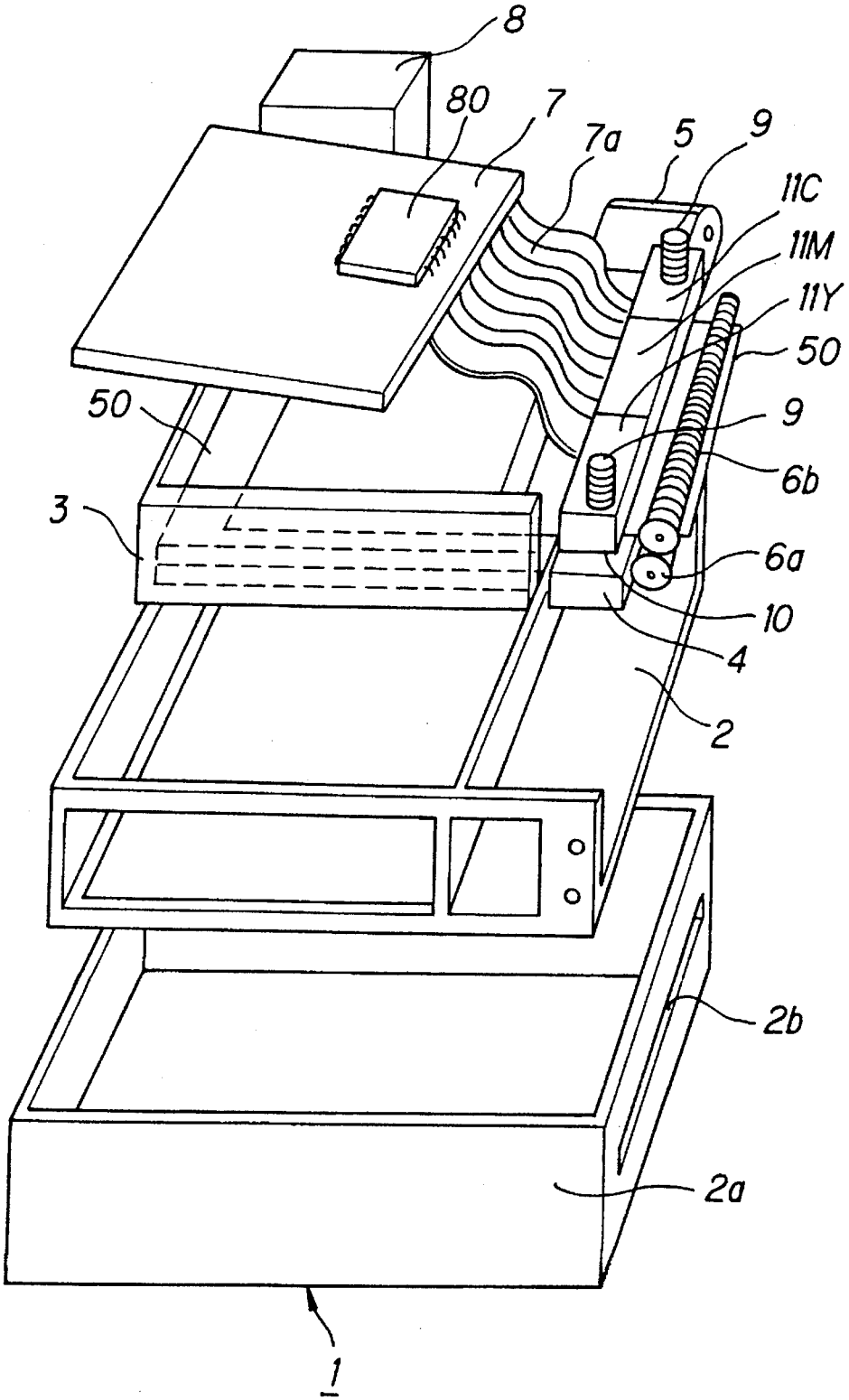
FIG. 4 is an exploded perspective view of the recording apparatus pertaining to the example.
Figure 5:
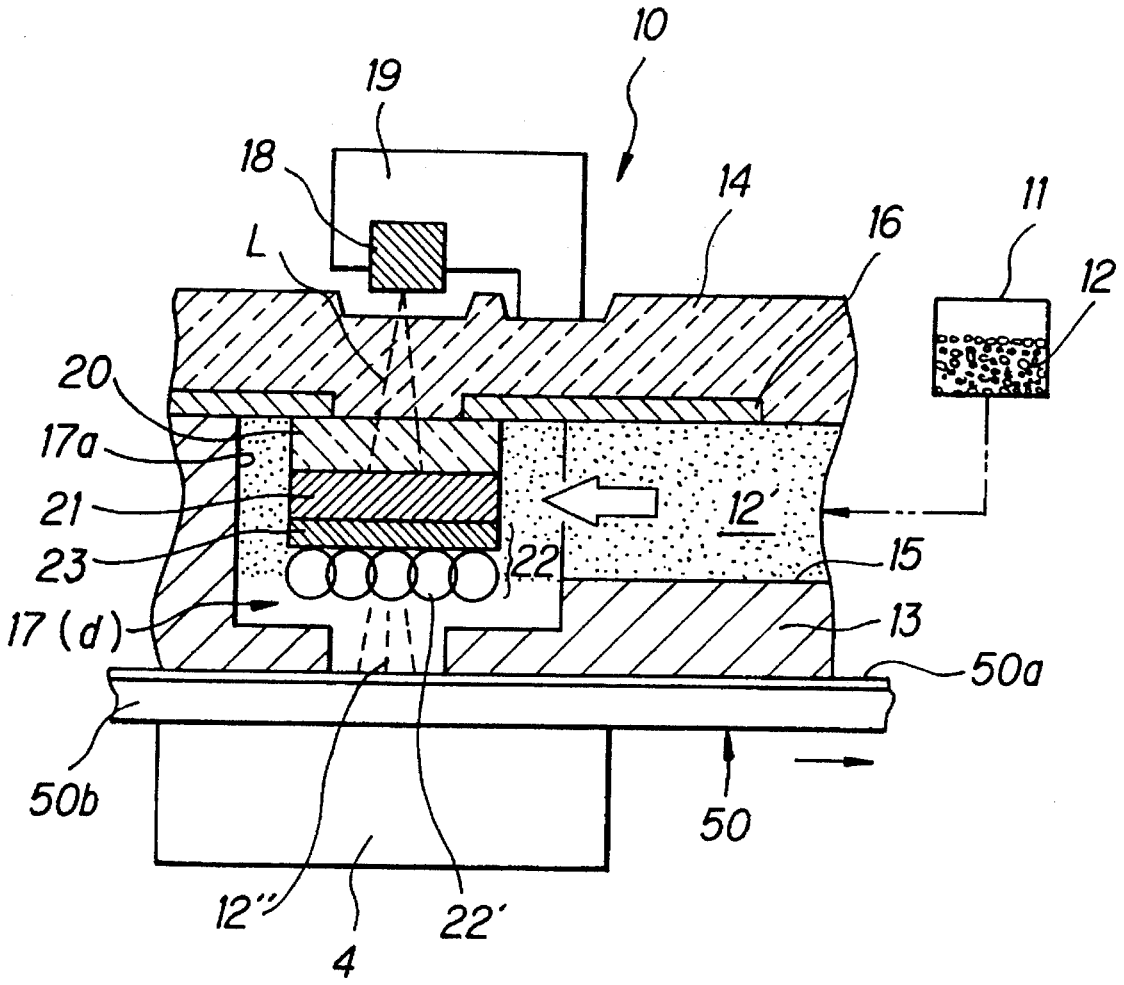
FIG. 5 is a partial sectional view of the recording part which illustrates the mechanism of the recording apparatus.

FIG. 3 is a sectional view of the recording part. FIG. 4 is an exploded perspective view of the recording apparatus. FIG. 5 is a schematic sectional view of the recording part which is intended to explain the mechanism of recording in this example. First, the mechanism of recording in this example is explained with reference to FIGS. 4 and 5.

In FIGS. 4 and 5, there is shown a color video printer of laser sublimation type 1. It is provided with a frame chassis 2 enclosed by a casing **2*a*, a cassette 3 accommodating recording paper 50, and a flat base 4** on which recording is carried out.

In the casing **2*a* is a paper drive roller 6*a*, which is driven by a motor 5, adjacent to the outlet 2*b* for recording paper. The recording paper 50 is held under light pressure between the paper drive roller 6*a* and the driven pressure roller 6*b*. Above the cassette 3 are a DC source 8 and a circuit board 7 to drive the head by the aid of a drive IC mounted thereon. There is shown a flexible harness 7*a* which connects the head drive circuit board 7 to the head (recording part) 10 disposed above the flat base 4**.

The head 10 is made up of the following major parts.

Solid dye vessels (11Y, 11M, 11C, collectively indicated by 11) which respectively contain sublimable yellow dye (12Y), magenta dye (12M), and cyan dye (12C) (collectively indicated by 12) which are in the form of solid powder;

A wear resistant protective layer 13 made of a high-strength material, which is at the bottom;

A head base 14 made of glass or transparent ceramic, which is at the top;

Liquefied dye vessels 15 like a narrow channel, in which the sublimable dyes 12 supplied from the respective dye vessels 11 are heated and liquefied by an electric resistance heater 16 attached to the head base 14;

Vaporizers 17 to vaporize the liquefied sublimable disperse dyes 12' supplied from the respective dye vessels 15; and Semiconductor chips as the laser sources 18 to throw the laser light L on the respective vaporizers 17. The semiconductor chips 18 are attached to the head base 14 through the bracket 19.

Each vaporizer 17 has an opening **17*a* which accommodates a transparent heat-insulating layer 20 attached to the head base 14, a light-heat converter layer 21 to absorb the laser light L and convert it into heat, which is laminated onto the transparent heat-insulating layer 20, an adhesive layer 23, and a layer of glass microspheres 22' to hold the liquefied sublimable dye 12', which is laminated onto the light-heat converter layer 21 through the adhesive layer 23. The transparent heat-insulating layer 20 is formed from transparent PET resin. The light-heat converter layer 21 is formed by coating the transparent heat-insulating layer 20** with a binder containing carbon fine particles.

The glass microspheres 22' are those which have a diameter of from 5 to 10 μm. The heater 16 is designed to heat and liquefy the sublimable dye 12 in the form of solid powder so that it diffuses and moves as far as the glass microspheres 22'.

When the color video printer of laser sublimation type 1 is in operation, the recording paper 50 is separated one sheet at a time from the cassette 3 and fed to the paper drive roller **6*a* through the gap between the flat base 4 and the head 10. The head 10 is pressed under a light load (about 50 g) against the flat base 4 by a pair of loading springs 9, 9, with the recording paper 50 interposed between them. In addition, the head 10 is provided with as many laser semiconductor chips 18 as picture elements in three rows corresponding to the primaries (Y, M, and C). The heated and liquefied dye is fed at a constant rate from the dye vessels 11 (11Y, 11M, 11C) to the respective vaporizers 17**.

In other words, the sublimable dye 12 in the form of solid powder in each dye vessel 11 is heated by the heater 16 up to its melting point and melted (liquefied). The liquefied sublimable dye 12' is fed at a constant rate by the capillary action of each liquefied dye vessel 15 to the glass microspheres 22' accommodated in the opening 17*a* of the vaporizer 17. When a sheet of recording paper 50 is interposed between the paper drive roller and the pressing driven roller 6*b*, signals (for each line, each color, and each dot) are sent to the head 10, and the laser semiconductor chip 18 emits the laser light L, which is converted into heat by the light-heat converter layer 21.

Thus, the liquefied sublimable dye 12' held by the glass microspheres 22' is vaporized. Each of the Y, M, and C sublimable dyes (disperse dyes) 12" in the form of vapor is transferred sequentially in the order of Y→M→C to the image receiving layer 50*a* formed on the recording paper 50 as the recording paper 50 passes through the gap between the flat base 4 and the protective layer 13. In this way color printing is accomplished.

In FIG. 3, there is shown the head 10 used for the color video printer 1 of laser sublimation type.

As in the case of the head shown in FIG. 5, the head 10 is made up of the following major parts;

Solid dye vessels (11Y, 11M, 11C, collectively indicated by 11) which respectively contain sublimable yellow dye 12Y, magenta dye 12M, and cyan dye 12C (collectively indicated by 12) which are disperse dyes in the form of solid powder;

A wear resistant protective layer 13 made of a high-strength material, which is at the bottom.

A head base 14 made of glass or transparent ceramic, which is at the top.

Liquefied dye vessels 15, in which the sublimable dyes 12 supplied from the respective dye vessels 11 are heated and liquefied by an electric resistance heater 16 attached to the head base 14;

Vaporizers 17 to vaporize the liquefied sublimable disperse dyes 12' supplied from the respective dye vessels 15; and Semiconductor chips as the laser sources 18 to throw the laser light L on the respective vaporizers 17. The semiconductor chips 18 are attached to the head base 14 through the bracket 19.

Each solid dye vessel 11 is connected to each liquefied dye vessel 15 through a passage 23 which is provided with a check valve 24. There is shown an optional means 25 to feed under pressure the liquefied sublimable dye to the vaporizer 17. This means may be a vibrator such as a piezoelectric transducer. It is positioned opposite the vaporizer 17 in the liquefied dye vessel 15. The check valve 24 closes the passage 23 when the supply means 25 is exerting pressure; but it keeps the passage 23 open when there is negative pressure or no pressure.

When the check valve 24 is open, the sublimable dye 12 in the form of solid powder is fed from the solid dye vessel 11 and heated and liquefied by the heater (16). The liquefied sublimable dye 12' stays in the liquefied dye vessel 15.

Each vaporizer 17 has the opening 17*a*, in which are a heat-resistant light-transmitting base 20, a light-heat converter 21, and a liquefied dye holder 22. The base 20 is attached to the head base 14 and as heat resistance, light-transmitting properties, and heat-insulating properties. The light-heat converter 21 is laminated onto the base 20 and absorbs the laser light L to convert it into heat. The dye holder 22 contains microspheres and holds by capillary action the heated and liquefied sublimable dye 12'.

The heat-resistant light-transmitting base 20 is a transparent film having heat resistance higher than 180° C., thermal conductivity lower than 1 W/m° C., near infrared transmission higher than 85% (10 μm thickness), specific heat lower than 2 J/g° C., and density lower than 3 g/cm$^3$. It is formed on the head base (14) by coating.

The light-heat converter 21 is a polyimide film.

The liquefied dye holder 22 is a metal thin film which is formed directly on the light-heat converter (21) and subsequently given a reticulate structure by etching.

The color video printer of laser sublimation type 1 mentioned above performs color printing in the following manner. The sublimable dye 12 in the form of solid powder in each dye vessel 11 is heated by the heater 16 up to its melting point and melted (liquefied). The liquefied sublimable dye 12' is rapidly fed at a constant rate by the dye supply means 25 in each dye vessel 15 and also by the capillary action of each dye vessel 15 to the heat-resistant light-transmitting base 20, the light-heat converter 21, and liquefied dye holder 22 contained in the opening 17*a* of the vaporizer 17.

For color printing on a sheet of recording paper 50, signals (for each line, each color, and each dot) are sent to the head 10, and the laser semiconductor chip 18 emits the laser light L, which is converted into heat by the light-heat converter layer 21. Thus, the liquefied sublimable dye 12' held by the dye holder 22 is vaporized. Each of the Y, M, and C sublimable disperse dyes 12" in the form of vapor is transferred sequentially in the order of Y→M→C to the image receiving layer 50*a* formed on the recording paper 50 as the recording paper 50 is fed into the gap between the flat base 4 and the protective layer 13. In this way, color printing is accomplished.

The vibrator 25 in each liquefied dye vessel 15 rapidly feeds at a constant rate under light pressure the liquefied disperse dye 12' in each liquefied dye vessel 15 to the light-heat converter 21 and liquefied dye holder 22. The check valve 24 in the passage 23 connecting the liquefied dye vessel 15 and the solid dye vessel 11 prevents with certainty the liquefied dye 12' from flowing back to the solid dye vessel 11 from the liquefied dye vessel 15.

The liquefied dye vessel 15 is provided with the heater 16 so that the liquefied disperse dye 12' is heated and kept liquid at all times.

The heat-resistant light-transmitting base 20 is durable for continuous use. The light-heat converter 21 laminated onto the heat-resistant light-transmitting base 20 is also durable for continuous use. In addition, it has such high thermal conductivity that it permits rapid heat dispersion along its surface even though the laser light L has an uneven light energy distribution (such as Gaussian distribution). This contributes to uniform temperature distribution and uniform dye transfer.

The liquefied dye holder 22 is a metal thin film which is formed by lamination on the light-heat converter 21 and subsequently given a reticulate structure with an adequate depth and pitch, so that it holds with certainty the liquefied disperse dye 12' in an amount required for printing at all times. Hence, the liquefied disperse dye 12' in an amount required for printing is constantly vaporized by the light-heat converter 21. The fact that the liquefied dye holder 22 is formed directly on the light-heat converter 21 obviates the necessity of an adhesion layer. This lowers the heat capacity and increases the heating efficiency.

Figure 6:
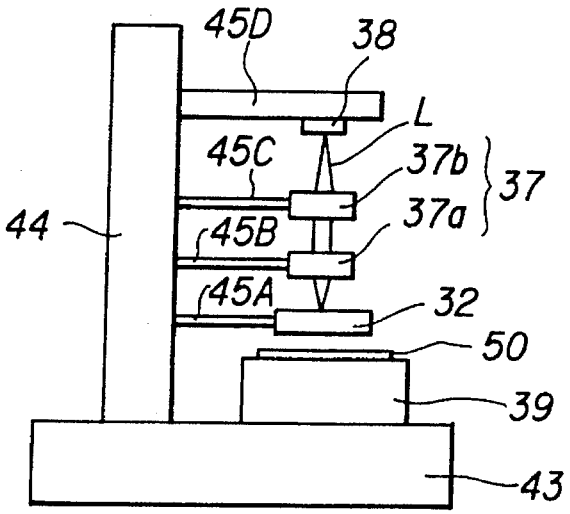
FIG. 6 is a front view of an experimental recording apparatus.

Recording in this example was examined for quality by the experiment mentioned below. FIG. 6 is a schematic front view of the apparatus used for the experiment.

The apparatus is made up of a base plate 43, a supporting column 44 standing thereon, brackets 45A, 45B, 45C, 45D fixed to the supporting column 44, and a recording chip 32, lenses 37*a* and 37*b*, and a semiconductor chip (SLD 203) 38 attached to the respective brackets, with their optical axes aligned. The lenses 37*a* and 37*b* constitute the focussing lens system 37. Under the recording chip (recording part) 32 is an X-Y stage 39 fixed to the base plate 43. Recording paper 50 is placed on the X-Y stage 39.

Figure 7:
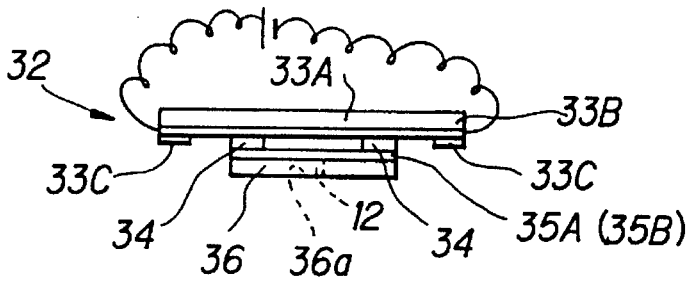
FIG. 7 is a front view of the recording chip of the experimental recording apparatus.
Figure 8:
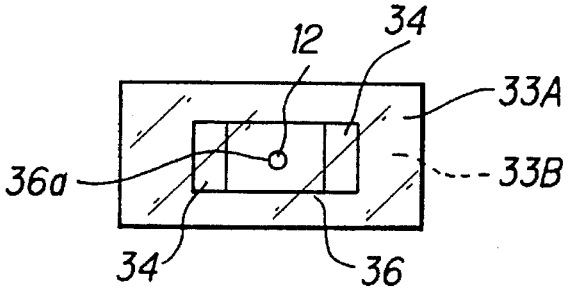
FIG. 8 is a plan view of the recording chip of the experimental recording apparatus.

FIG. 7 is a front view of the recording chip 32. FIG. 8 is a plan view of the recording chip 32.

Figure 9:
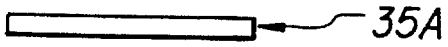
FIG. 9 is an enlarged front view of the light-heat converter (polyimide film) of the experimental recording apparatus.

The recording chip 32 has a transparent conductive film 33B of indium-tin oxide (ITO) which is formed by deposition on the lower surface of a glass plate 33A. To the transparent conductive film 33B is fixed a polyimide film 35A, with spacers 34, 34 between. The polyimide film 35A ("Sled" from DuPont) is shown in FIG. 9. It functions as the light-heat converter. The lower side of the polyimide film 35A is covered with a 10-μm thick stainless steel cover 36. At the center of the cover 36 is a through hole (1 mm in diameter) 36*a* to hold the dye. There is a 10 μm gap between the cover 36 and the recording paper 50.

The dye holding hole 36*a* is filled with a dye 12 as the recording material. The dye 12 is melted by heating at 150° C. Heating is accomplished by application of a voltage across a pair of electrodes 33C, 33C attached to the transparent conductive film 33B. With the recording paper 50 moving at a relative speed of 10 cm/s, the molten dye is vaporized by irradiation with the laser light L emitted by the laser semiconductor chip 38. The vaporized dye is transferred to the image receiving layer on the recording paper 50.

The laser light L has a wavelength of 800 nm and an output of 30 mW on the surface of the recording chip 32. It impinges upon the molten dye within an area of 20×30 μm. The recording paper 50 is composed of a 180-μm thick substrate of synthetic paper and a 6-μm thick image receiving layer of polyester formed thereon by coating.

Using the above-mentioned apparatus and a dye (as the recording material mentioned below), continuous recording was carried out. The recording paper was heated at 150° C. for 10 ms by a heated blade, so that the dye which had been transferred to the image receiving layer of polyester was diffused and fixed completely in the image receiving layer. The thus obtained recorded image of stripe pattern was tested for average line width and optical density.

EXPERIMENT 1

A recording dye was prepared by mixing a tricyanostyryl magenta dye (HSR-2031) and an infrared absorbing naphthalocyanine dye. The former has a melting point of 125° C. and a boiling point of 380° C. and is represented by the structural formula below. The latter exhibits the absorption maximum at a wavelength of 800 nm and is represented by the structural formula below.

Magenta dye (HSR-2031)

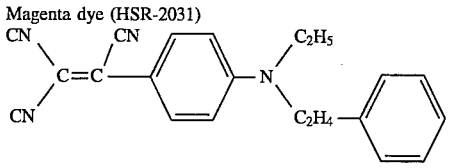

Infrared absorbing naphthalocyanine dye

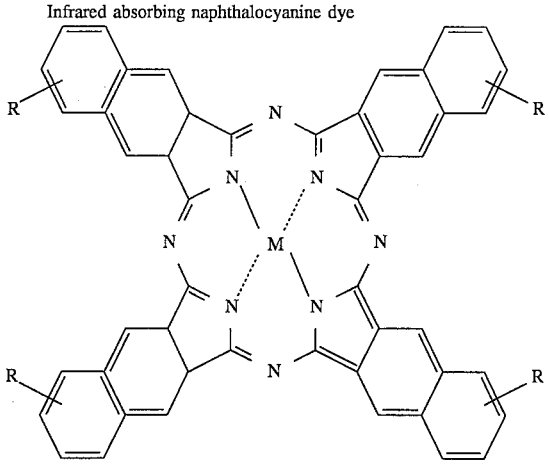

M=metal, R=t—$C_5H_{11}$

The mixing ratio is 100 parts of HSR-2031 to 2 parts of naphthalocyanine dye. It is known that the naphthalocyanine dye remains stable up to 350° C. when tested by differential thermal analysis (thermogravimetry).

It was found that the magenta dye formed on the image receiving layer a stripe image which has an average line width of 105 μm and an optical density of 2.2 (measured by a Macbeth densitometer).

After recording operation for 60 minutes, the recording chip was placed in a beaker and the remaining naphthalocyanine dye in the dye layer was extracted with acetone. It was found that the amount of the remaining naphthalocyanine dye was about 75% of the initial amount. This decrease is due to transfer to the recording paper and thermal decomposition. The naphthalocyanine dye which had been transferred to the image receiving layer is not completely invisible because it has no absorption in the visible region. Therefore, the recording paper was not substantially stained.

EXPERIMENT 2

The same procedure as in Experiment 1 above was repeated except that a dicyanostyryl yellow dye (ESC-155) was used which has a melting point of 115° C. and a boiling point of 390° C. and is represented by the structural formula below.

Yellow dye ESC-155

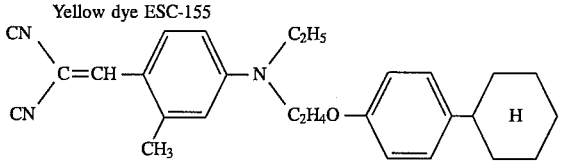

It was found that the yellow dye formed on the image receiving layer a stripe image which has an average line width of 110 μm and an optical density of 2.0 (measured by a Macbeth densitometer).

EXPERIMENT 3

The same procedure as in Experiments 1 and 2 above was repeated except that an anthraquinone cyan dye (ESC-655) was used which has a melting point of 145° C. and a boiling point of 400° C. and is represented by the structural formula below.

Cyan dye ESC-655

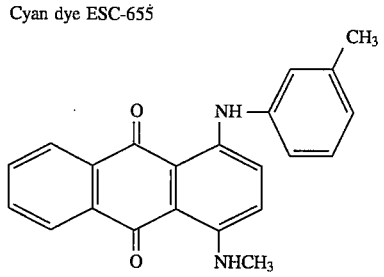

It was found that the cyan dye formed on the image receiving layer a stripe image which has an average line width of 95 μm and an optical density of 2.0 (measured by a Macbeth densitometer).

EXPERIMENT 4

The same procedure as in Experiments 1, 2, and 3 above was repeated except that the magenta dye, yellow dye, and cyan dye were used to record a stripe image on the recording paper by superimposing them sequentially. As the result, a black image (due to color mixing) was formed on the image receiving layer.

EXPERIMENT 5

A mixture was prepared by mixing in the ratio shown below from the above-mentioned magenta dye (HSR-2031) and a surface-treated titanyl phthalocyanine as the near infrared absorbing pigment. The latter has an average particle size of 0.2 μm. It is coated with polycarbonate by ball-milling for 48 hours together with 5 parts by weight of polycarbonate (Z-200 made by Mitsubishi Chemical Industries Ltd.). It remains stable up to 450° C. according to the thermogravimetry by differential thermal analysis.

| | |
|---|---|
| HSR-2031 | 100 pbw |
| Phthalocyanine pigment | 10 pbw |

The thus prepared mixture was charged into an apparatus as shown in FIGS. 6 to 9. Upon melting by heating at 150° C., with the transparent conductive film (33B energized, the mixture became a flat layer (4 μm thick). It was found that the surface-treated titanyl phthalocyanine pigment had been uniformly dispersed in the dye. Recording was carried out in the same manner as in Experiment 1 above.

The magenta dye yielded on the image receiving layer a stripe image having an average line width of 95 μm and an optical density of 2.0 (measured by a Macbeth densitometer). Incidentally, it was found that the titanyl phthalocyanine pigment did not transfer to the image receiving layer at all.

EXPERIMENT 6

(a) Synthesis of a cellulosic polymer (having a laser-absorbing dye in the side chains) as the laser-absorbing dye A 500 ml round-bottom flask was charged with 10 g of Kayacion Turquise P-NGF (C.I. Reactive Blue 15, made by Nippon Kayaku Co., Ltd.), 10 g of ethyl cellulose having an average molecular weight of 12000, and 200 ml of water. After complete dissolution, the solution was stirred with 2 g of sodium carbonate and 20 g of urea at room temperature for 20 minutes. Stirring was continued at 80° C. for 60 minutes. The reaction product (in the form of aqueous solution) was thoroughly mixed with 100 ml of toluene in a separatory funnel.

The oil phase was freed of solvent by evaporation using an evaporator, and the residues were vacuum-dried. Thus there was obtained 12 g of polymeric laser-absorbing agent (ethyl cellulose having a dye in the side chains). It has the absorption maximum at 670 nm in acetone.

(b) A mixture was prepared by mixing in the ratio shown below from a magenta dye (HSR-2031) as the recording dye and the polymeric laser-absorbing agent prepared as above.

| | |
|---|---|
| HSR-2031 | 100 pbw |
| Polymeric laser-absorbing agent | 5 pbw |

The thus prepared mixture was charged into the apparatus as shown in FIGS. 6 to 9. Upon melting by heating at 150° C., with the transparent conductive film 33B energized, the mixture became a flat layer (4 μm thick). It was found that the polymeric laser-absorbing agent had been uniformly dispersed in the dye.

Recording was carried out in the same manner as in Experiment 1 above. Since the polymeric laser-absorbing agent has the absorption maximum in the neighborhood of 670 nm, the laser semiconductor chip 38 is SLD-151V which emits laser with a wavelength of about 670 nm. Irradiation and scanning were carried out so as to cover an area of 20×30 μm on the recording chip 32, with the output being 5 mW. The recording paper 50 was moved at a relative speed of 1 cm/s.

The magenta dye yielded on the image receiving layer a stripe image having an average line width of 90 μm and an optical density of 1.9 (measured by a Macbeth densitometer). Incidentally, it was found that the polymeric laser-absorbing agent did not transfer to the image receiving layer at all.

EXPERIMENT 7

(a) Synthesis of a laser-absorbing dye (as the laser-absorbing agent) having a surface active agent as a counter ion One gram of cyanine dye (NK-125) was dissolved in a mixed solvent (100 g of water and 1 g of ethanol) contained in a 500 ml separatory funnel. The solution was stirred at room temperature for 20 minutes with 1 g of sodium stearate which had been partially fluorinated so as to improve its surface activity. The reaction product (in the form of aqueous solution) was thoroughly mixed with 10 ml of toluene in a separatory funnel.

The oil phase was freed of solvent by evaporation using an evaporator, and the residues were vacuum-dried. Thus there was obtained 1.0 g of surface-active laser-absorbing agent (cyanine dye containing a surface active agent).

It has the absorption maximum at 780 nm in acetone. When it is dispersed into a solution of phthalic ester, segregation occurs at the interface in contact with the air.

(b) Recording test

A mixture was prepared by mixing in the ratio shown below from a magenta dye (HSR-2031) as the recording dye and the surface-active laser-absorbing agent prepared as above.

| | |
|---|---|
| HSR-2031 | 100 pbw |
| Surface-active laser-absorbing agent | 5 pbw |

Figure 10:
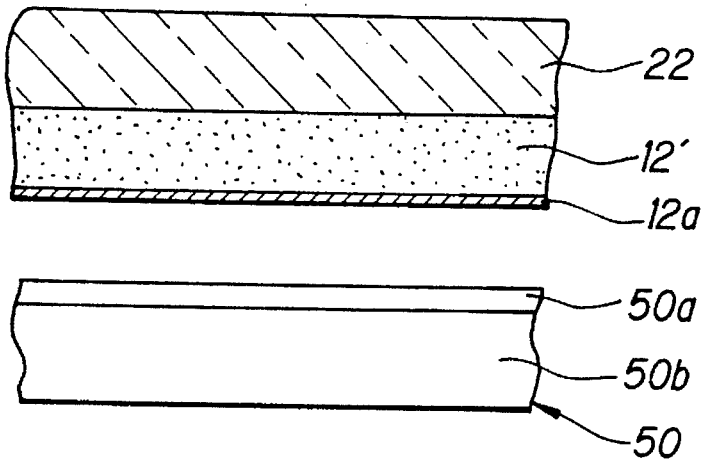
FIG. 10 is an enlarged sectional view showing the pigment for light-heat conversion which is in the state of segregation.

The thus prepared mixture was charged into the apparatus as shown in FIGS. 6 to 9. Upon melting by heating at 150° C., with the transparent conductive film 33B energized, the mixture became a flat layer (4 μm thick). It was found that the surface-active laser-absorbing agent underwent segregation such that the recording dye arrange itself along the interface in contact with the air. An enlarged view of this is shown in FIG. 10 (in which the reference numbers are common to those in FIG. 3). There are shown the surface-active laser-absorbing agent 12*a* and the air gap layer 17 in which vaporization takes place.

Recording was carried out in the same manner as in Example 1 above. The magenta dye yielded on the image receiving layer a stripe image having an average line width of 110 μm and an optical density of 2.3 (measured by a Macbeth densitometer).

For the purpose of comparison with Experiments 1 to 3 and Experiments 5 to 7, the following experiments were carried out.

COMPARATIVE EXPERIMENT 1

Figure 11:
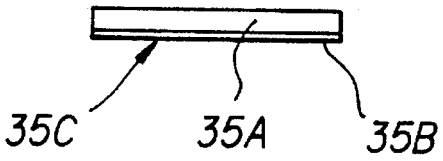
FIG. 11 is an enlarged front view of the light-heat converter of the experimental recording apparatus.

The same recording apparatus as shown in FIGS. 6 to 8 was used, except that the polyimide film ("Sled" film) 35A shown in FIG. 9 was replaced by the polyimide film 35C, shown in FIG. 11, as the light-heat converter. The latter is composed of the polyimide film 35A (the one shown in FIG. 9) and a 0.2 μm thick nickel-cobalt alloy film 35B vacuum-deposited on its back side for heat storage.

Magenta dye (HSR-2031) as the recording dye alone was filled into the dye holder 36*a* shown in FIG. 8. Upon melting by heating at 150° C., with the transparent conductive film 33B in FIG. 7 energized, the dye became a flat layer (4 μm thick). A laser beam emitted by the laser semiconductor chip (SLD 203) 38 was focused by the lens 37 in FIG. 6 upon the nickel-cobalt layer 35B, which is on the dye holder 36*a*. The focusing area on the deposited layer is 20×30 μm and the output on the polyimide film 35C was 30 mW.

During irradiation with a laser beam, the recording paper 50 was moved at a relative speed of 10 cm/s, with a 10 μm gap between the recording paper and the cover 36. The recording paper is composed of a substrate of synthetic paper (180 μm thick) and a polyester image-receiving layer (6 μm thick) formed thereon. The dye was transferred to the image receiving layer of the recording paper. Upon heating at 150° C. for 10 ms with a heated blade, the dye completely dispersed into the polyester image receiving layer and fixed there. The magenta dye yielded on the image receiving layer a stripe image having an average line width of 85 μm and an optical density of 1.8 (measured by a Macbeth densitometer).

COMPARATIVE EXPERIMENT 2

The same procedure as in Comparative Experiment 1 was repeated except that an yellow dye (ESC-155) alone was used as the recording dye.

The yellow dye yielded on the image receiving layer an image having an average line width of 85 μm and an optical density of 1.7 (measured by a Macbeth densitometer).

COMPARATIVE EXPERIMENT 3

The same procedure as in Comparative Experiment 1 was repeated except that an cyan dye (ESC-655) alone was used as the recording dye.

The cyan dye yielded on the image receiving layer an image having an average line width of 75 μm and an optical density of 1.6 (measured by a Macbeth densitometer).

COMPARATIVE EXPERIMENT 4

A mixture was prepared by mixing in the ratio as in Experiment 5 from a magenta dye (HSR-2031) as the recording dye and a titanyl phthalocyanine (as the near infrared absorbing pigment) without surface treatment. The latter has an average particle size of 0.2 μm.

The thus prepared mixture was charged into an apparatus as shown in FIGS. 6 to 8, which is provided with the polyimide film 35A as shown in FIG. 9. Upon melting by heating at 150° C., with the transparent conductive film 33B energized, the mixture became a flat layer (4 μm thick). It was found that the titanyl phthalocyanine pigment without surface treatment had settled down on the bottom of the recording dye layer. Then, recording and fixing were carried out in the same manner as in Experiment 5.

The magenta dye yielded on the image receiving layer an image having an average line width of 70 μm and an optical density of 1.6 (measured by a Macbeth densitometer). Incidentally, it was found that the titanyl phthalocyanine pigment did not transfer to the image receiving layer at all.

COMPARATIVE EXPERIMENT 5

Experiment was carried out using the same apparatus as used in Comparative Experiment 1 (with polyimide film 35C as shown in FIG. 11) and a magenta dye (HSR-2031) alone as the recording dye. A laser beam emitted by a laser semiconductor chip SLD-151V was condensed to an area of 20×30 μm on the light-heat converting layer. The output was 5 mW. During irradiation with a laser beam, the recording paper was moved at a relative speed of 1 cm/s, with a 10 μm gap between the recording paper and the recording chip 32. The magenta dye yielded on the image receiving layer an image having an average line width of 65 μm and an optical density of 1.5 (measured by a Macbeth densitometer).

COMPARATIVE EXPERIMENT 6

A mixture was prepared in the same manner as in Experiment 7 from a magenta dye (HSR-2031) as the recording dye and a surface-active laser absorbing agent (cyanine pigment) NK-125. The mixture was charged into the apparatus provided with the polyimide film 35A shown in FIG. 9. Upon melting by heating at 150° C., with the transparent conductive film 33B energized, the mixture became a flat layer (4 μm thick). It was found that the surface active laser-absorbing agent had settled down on the bottom of the recording dye layer. Then, recording and fixing were carried out in the same manner as in Experiment 7.

The magenta dye yielded on the image receiving layer an image having an average line width of 75 μm and an optical density of 1.6 (measured by a Macbeth densitometer).

The results of Experiments 1 to 3 and 5 to 7 and their corresponding Comparative Experiments 1 to 6 are tabulated below.

TABLE

| Experiment No. (Comparative Experiment No.) | Recording density (OD) | Line width (μm) | Recording sensitivity (μg/J) |
|---|---|---|---|
| 1 | 2.2 M | 105 | 59 |
| 2 | 2.0 Y | 110 | 56 |
| 3 | 2.0 C | 95 | 97 |
| 5 | 2.0 M | 95 | 49 |
| 6 | 1.9 M | 95 | 26 |
| 7 | 2.3 M | 110 | 64 |
| (1) | 1.8 M | 85 | 39 |
| (2) | 1.7 Y | 85 | 37 |
| (3) | 1.6 C | 75 | 62 |
| (4) | 1.6 M | 70 | 29 |
| (5) | 1.5 M | 65 | 15 |
| (6) | 1.6 M | 75 | 31 |

Note:
Recording density is expressed in terms of the amount of the dye which had been transferred to the recording paper by 1 J of energy.

It is noted from the Table above that all the experiments pertaining to the present invention produced better results than the comparative experiments with regard to the recording density, image line width, and recording sensitivity for the magenta, yellow, and cyan dyes tested.

The recording apparatus is not limited to the one shown in FIG. 3. It may be replaced by those which are constructed shown in FIGS. 12, 13, and 14.

Figure 12:
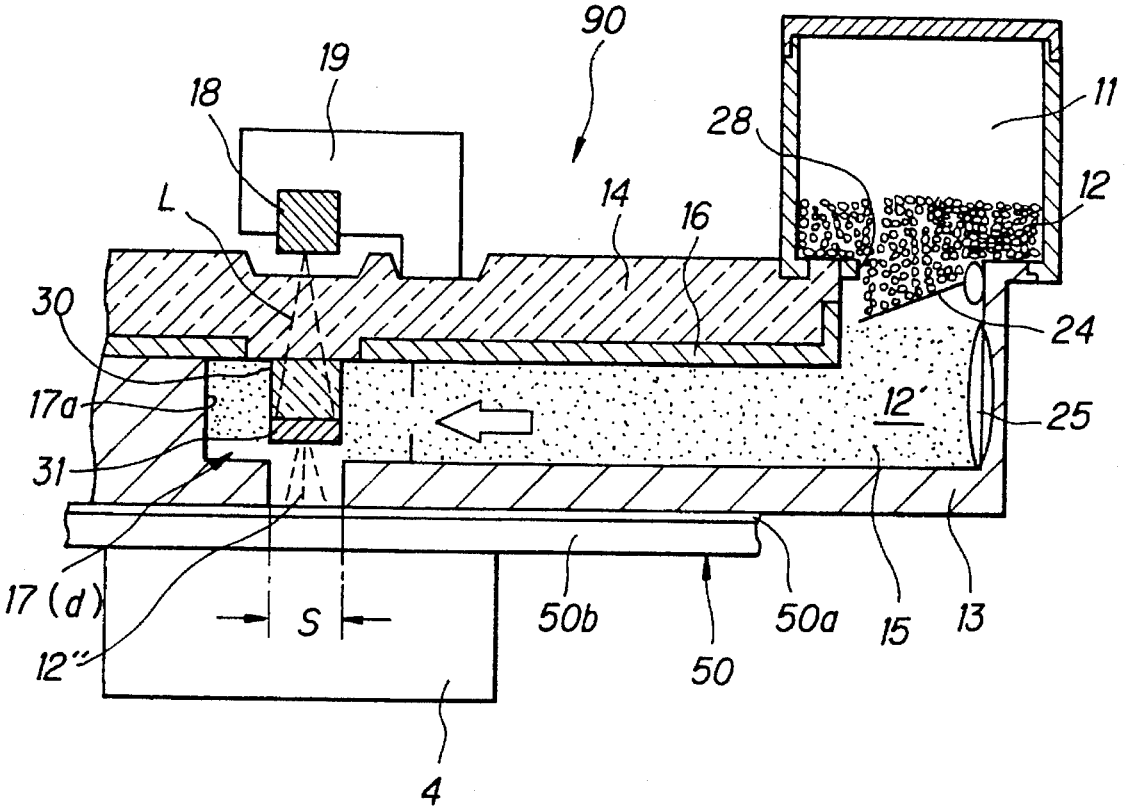
FIG. 12 is a sectional view of the recording part of the recording apparatus pertaining to another example.

FIG. 12 shows a head used for the color video printer of laser-sublimation type.

As in the case of the head shown in FIG. 3, the head 90 is made up of the following major parts:

Solid dye vessels 11 which respectively contain sublimable dyes 12 which are disperse dyes in the form of solid powder;

Liquefied dye vessels 15, in which the sublimable dyes 12 supplied from the respective dye vessels 11 are heated and liquefied by an electric resistance heater 16 attached to the head base 14;

Vaporizers 17 to vaporize the liquefied sublimable disperse dyes 12' supplied from the respective liquefied dye vessels 15;

Semiconductor chips 18 to throw the laser light L on the respective vaporizers 17. They are attached to the head base 14 through the bracket 19;

A check valve 24 placed in the passage 23 connecting each solid dye vessel 11 and each liquefied dye vessel 15; and A vibrator 25 to feed under pressure the liquefied sublimable dye 12' to the vaporizer 17. It is positioned opposite to the vaporizer 17 in the liquefied dye vessel 15.

Each vaporizer 17 has the opening 17*a*, in which are a heat-resistant light-transmitting resin component 30 and a light-heat converter 31. The former is attached to the head base 14 and has both heat-insulating and light-transmitting properties. The latter is laminated onto the heat-resistant light-transmitting resin component 30 and absorbs the laser light L to convert it into heat. The heat-resistant light-transmitting resin component 30 is made of aromatic polyamide (aramid), and the light-heat converter 31 is made of polyimide resin.

Figure 15A:
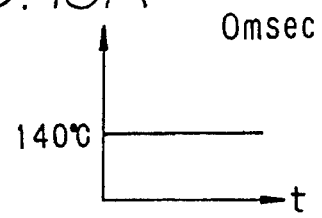
FIGS. 15A, 15B, 15C and 15D are diagrammatic representation to illustrate how the duration of laser light irradiation relates to the temperature of the heat-resistant light-transmitting resin and also to the transfer of the dye.
Figure 15B:
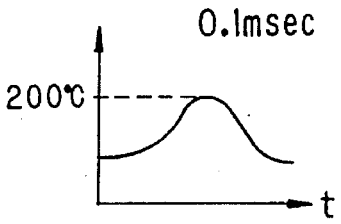
Figure 15C:
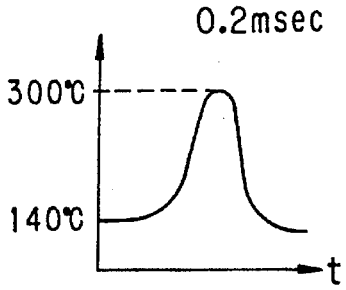
Figure 16C:
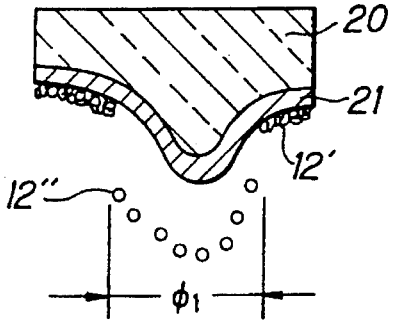
Figure 15D:
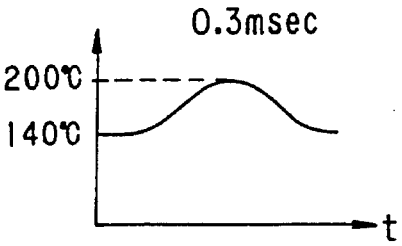
Figure 16D:
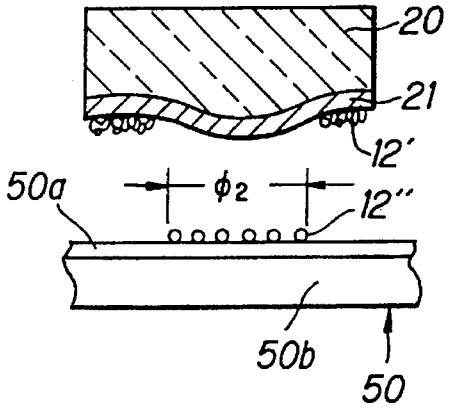

When each laser semiconductor 18 emits laser light L instantaneously, the laser light L passes through the glass head base 14 and the heat-resistant light-transmitting resin component 30, reaching the light-heat converter 31, where the laser light L is converted into heat according to the light energy distribution. This heat rapidly spreads through the heat-resistant light-transmitting resin component 30 as exaggeratedly shown in FIG. 15A to FIG. 15C and FIG. 16A and FIG. 16C. The spread heat gives kinetic energy to the liquefied sublimable dye 12' sticking to the light-heat converter 31 so that the dye flies toward the image receiving layer 50*a* of the recording paper 50, as shown in FIG. 15C. As the result, the sublimable dye 12" which has been vaporized in proportion to the amount of heat sticks to the image receiving layer 50*a* of the recording paper 50, as shown in FIGS. 15D and 16D. In this way a gradated image is obtained.

In FIG. 15C, $\phi_1$ (=100 μm) denotes the diameter of the spot irradiated by the laser light L, and in FIG. 15D, $\phi_2$ (=60–80 μm) denotes the diameter of one dot (picture element). Each of the Y, M, and C sublimable dyes 12" in the form of vapor is transferred sequentially in the order of Y→M→C to the image receiving layer 50*a* formed on the recording paper 50 as the recording paper 50 passes through the gap between the flat base 4 and the protective layer 13. In this way color printing is accomplished.

In addition, the fact that the heat-resistant light-transmitting resin component 30 is made of aromatic polyamide is responsible for its improved heat resistance and its long-life durability.

Figure 13:
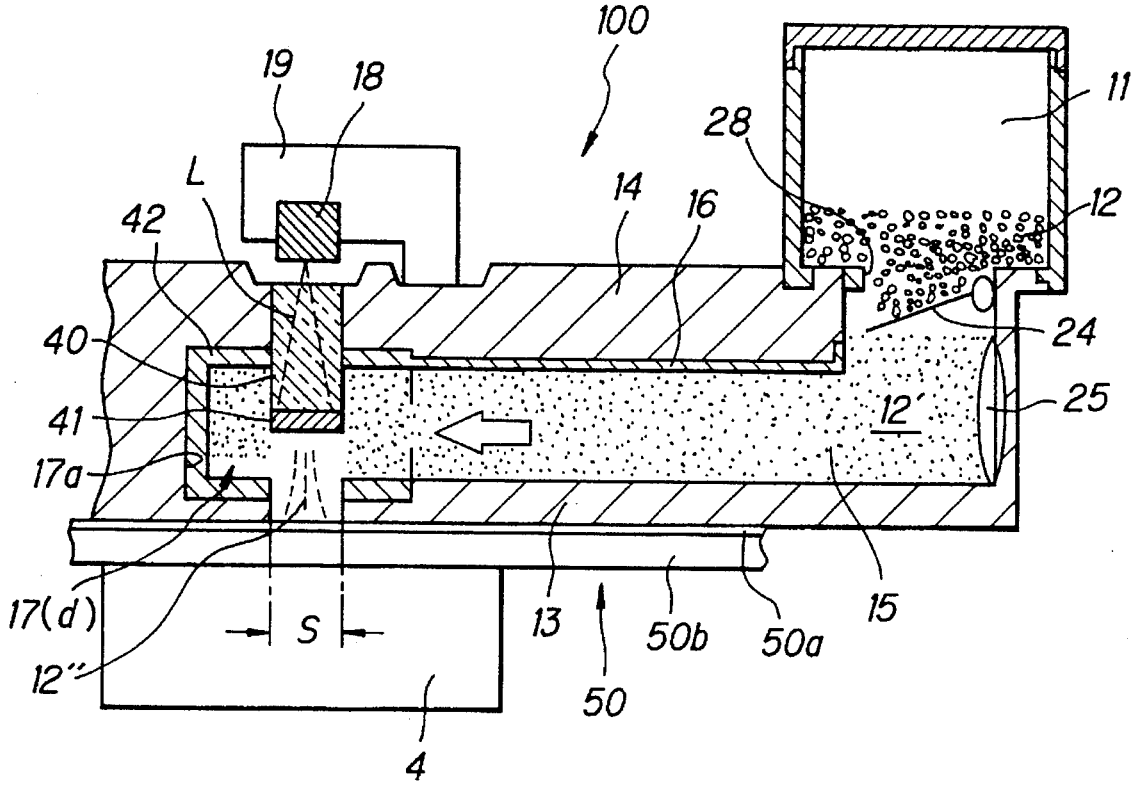
FIG. 13 is a sectional view of the recording part of the recording apparatus pertaining to further another example.

FIG. 13 shows another head used for the color video printer of laser-sublimation type. The head 100 is made up of the following major parts:

Solid dye vessels 11 which respectively contain sublimable dyes 12 which are disperse dyes in the form of solid powder;

Liquefied dye vessels 15, in which the sublimable dyes 12 supplied from the respective solid dye vessels 11 are heated and liquefied by an electric resistance heater 16 attached to the protective layer 13;

Vaporizers 17 to vaporize the liquefied sublimable disperse dyes 12' supplied from the respective liquefied dye vessels 15;

Semiconductor chips 18 to throw the laser light L on the respective vaporizers 17. They are attached to the protective layer 13 through the bracket 19;

A check valve 24 placed in the passage 23 connecting each solid dye vessel 11 and each liquefied dye vessel 15; and A vibrator 25 to feed under pressure the liquefied sublimable dye 12' to the vaporizer 17. It is positioned opposite to the vaporizer 17 in the liquefied dye vessel 15.

Each vaporizer 17 has the opening 17*a*, in which are an optical fiber 40 and a light-heat converter 41. The former passes through the head base 14 and reaches the opening 17*a* to lead the laser light L. The latter absorbs the laser light L led through the optical fiber 40 and converts it into heat. The optical fiber 40 is designed to lead the laser light L to the light-heat converter 41 without causing leakage to outside. The light-heat converter 41 is polyimide film. The opening 17*a* of the vaporizer 17 is so constructed as to supply the liquefied sublimable dye 12'. It is surrounded by a heat-insulating material 42.

The laser light L emitted by the laser semiconductor chip 18 passes through the optical fiber and reaches the light-heat converter 41, where the laser light L is converted into heat according to the light energy distribution. This heat vaporizes the liquefied sublimable dye 12' sticking to the light-heat converter 41. Each of the Y, M, and C sublimable dyes 12" in the form of vapor is transferred sequentially in the order of Y→M→C to the image receiving layer 50*a* formed on the recording paper 50 as the recording paper 50 passes through the gap between the flat base 4 and the protective layer 13. In this way color printing is accomplished.

The light-heat converter 41 is laminated onto the lower side of the optical fiber 40 as mentioned above. This structure is responsible for its improved heat resistance and durability. In addition, it has such high thermal conductivity that it permits rapid heat spread along its surface even though the laser light L has an uneven light energy distribution (such as Gaussian distribution). This contributes to uniform temperature distribution and uniform dye transfer.

A heat-insulating material 42 surrounds the lower part of the optical fiber 40 and the opening 17*a* of the vaporizer 17 which accommodates the light-heat converter 41, so that the light-heat converter 41 vaporizes the liquefied sublimable dye 12' efficiently, without heat escaping from the system.

All of the above-mentioned examples are designed such that the laser light is thrown downward from the upper part of the heat and recording is made on the recording paper placed at the underside. It is possible to design a head in which the positions are reversed as shown in FIG. 14.

Figure 14:
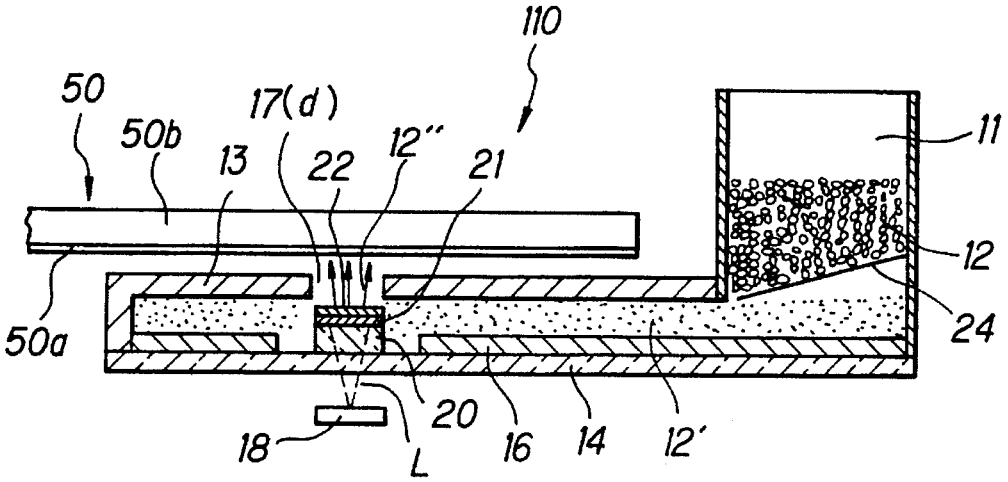
FIG. 14 is a sectional view of the recording part of the recording apparatus pertaining to still further another example.
Figure 16A:
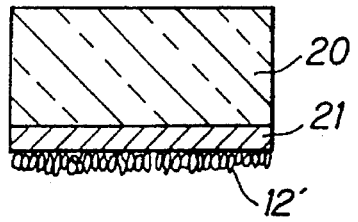
FIGS. 16A, 16B, 16C and 16D are sectional views corresponding respectively to FIGS. 15A, 15B, 15C and 15D.
Figure 16B:
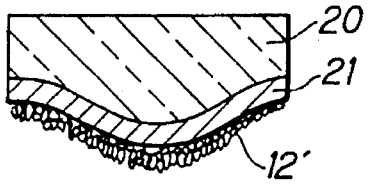

The head 110 shown in FIG. 14 is made up of a head base 14, a heater 16, a heat-resistant light-transmitting base 20, a light-heat converter 21, and a liquefied dye holder 22. The heater 16 is attached to the head base 14, and the last three components are laminated sequentially upward onto the head base 14. The heater 16 heats and melts the solid dye 12 supplied from each solid dye vessel 11, thereby converting it into the liquefied sublimable dye 12'.

Under the head base 14 is a laser semiconductor chip 18, which throws laser light L upon the liquefied dye contained in the liquefied dye holder 22 so as to vaporize it. The vapor of the dye moves upward through the vaporizer 17 to the dye receiving layer 50*a* of the recording paper 50.

Other functions are the same as those of the head 10' shown in FIG. 3. Needless to say, it is possible that the head has the same structure as the head 10" shown in FIG. 13, with the arrangement inverted.

It is desirable that the light-heat converter 21 in FIG. 3, 31 in FIG. 12, or 41 in FIG. 13 be not made of polyimide but be composed of a heat-resistant light-transmitting base 20 in FIG. 3, 30 in FIG. 12, or 40 in FIG. 13 and a thin film of nickel-cobalt alloy formed thereon by vacuum deposition or sputtering. The latter has a near infrared transmission higher than 0.9, a thickness smaller than 1 μm, a specific heat higher than 0.5 J/g° C., a thermal conductivity higher than 20 W/m° C., and a density lower than 20 g/cm$^3$.

In this case, the thin film may have an area equal to the recording area S for the vaporized dye, as shown in FIGS. 3, 12, 13, and 14. In this way it is possible to improve the light-heat converter in heat resistance for its continuous use and to reduce its thickness and heat capacity. The light-heat converter is surrounded by the liquefied dye which functions as a heat insulator to increase the heating efficiency.

Although the above-mentioned systems perform recording by liquefying a solid dye and then vaporizing the liquefied dye, it is possible to construct a system which performs recording by vaporizing (or ablating) a solid dye directly with heat of a laser beam.

The embodiments of the present invention have been described. It is possible to modify the embodiments in varied ways without departing from the scope of the invention.

For example, the recording layer and head may have other structure and form than mentioned above and the components of the head may be made of any adequate material.

Monochromatic and black-and-white recording is also possible in addition to the full-color recording with three recording dyes (magenta, yellow, and cyan).

The laser light as the energy source to vaporize or ablate the heat-fusible recording material (such as dye) may be replaced by electromagnetic wave or electrical discharge from stylus electrodes.

The recording apparatus of the present invention is constructed such that the layer of a heat-fusible recording material (which faces the recording medium with a gap between) is selectively heated to be vaporized or ablated, so that the vapor of the dye moves to the recording medium through the gap, and the recording material contains a heat energy absorber which promotes the heating of the recording material. Therefore, the present invention produces the following effects.

Since the recording material does not come into contact with the recording medium, no support is required to supply the recording material. This implies that there will be no wastes originating from the support and the recording material remaining unused on the support. In addition, recording is performed by heating the recording material alone. This leads to a high energy efficiency. Moreover, no load is required to bring the recording material into contact with the recording medium. This leads to the size and weight reduction of the recording apparatus.

In the case where several recording materials are used in layers, there is no possibility that the previously deposited recording material stains the recording material to be deposited next. Since the recording material contains a heat energy absorber, it is possible to produce clear, dense prints with a minimum of energy loss.

As the result, high-quality recording is guaranteed at all times. The recording apparatus does not need an energy absorbing means. This permits the size and weight reduction of the apparatus.

What is claimed is:

1. A recording apparatus which comprises a recording part in which a layer of a heat-fusible recording material is formed opposite a recording medium with a gap between, said recording part being so constructed as to selectively heat said heat-fusible recording material, thereby vaporizing or ablating it, and transfer the vapor to said recording medium through said gap, said recording material containing a heat energy absorber which promotes the heating of the recording material.

2. A recording apparatus as defined in claim 1, wherein the recording material contains uniformly dissolved therein a light-heat converting dye which, upon irradiation with light, absorbs the light of specific wavelength and heats the recording dye.

3. A recording apparatus as defined in claim 1, which further comprises a semiconductor to emit laser as an energy source to selectively vaporize or ablate the recording material, and a means to continuously feed the recording medium to the recording part, said recording medium having an image receiving layer which faces, with a gap between, the layer of the recording material in the recording part.

4. A recording apparatus as defined in any of claim 1, wherein the recording dye contains uniformly dissolved therein a light-heat converting polymeric material which has in the main chains or side chains, or at the terminals a dye segment capable of absorbing the light of specific wavelength which is irradiated to heat the recording dye.

5. A recording apparatus as defined in any of claim 1, wherein the recording material contains a light-heat converting pigment capable of absorbing the light of specific wavelength irradiated for heating, said pigment being surface-treated for improved dispersion into the recording material.

6. A recording apparatus as defined in any of claim 2, wherein at least one of the light-heat converting dye, light-heat converting polymeric material, and light-heat converting pigment is in the state of uniform segregation at the interface between the layer of the recording material and the gap.

7. A recording method which comprises transferring the recording material to the recording medium by using the recording apparatus defined in any of claim 1.

8. A laser color printer, comprising:

a dye vessel for holding solid dye powder;

a heated conduit for receiving solid dye powder from said vessel and heating said solid dye powder to a liquid state, creating liquid dye;

a volume for receiving said liquid dye;

a light-heat converter arranged adjacent said volume;

a laser arranged above said light-heat converter and arranged for directing laser light onto said light-heat converter for causing heat from said converter to vaporize selected regions of said liquid dye in said volume, creating vaporized dye; and a platform for holding a sheet of paper adjacent said volume across a gap, arranged for said vaporized dye to impinge said sheet of paper for printing.

9. The printer according to claim 8, further comprising a light transmitting base arranged laminated with said light-heat converter.

10. The printer according to claim 8, wherein said heated dye conduit further comprises a vibrator for assisting translation of said dye through said conduit.

11. The printer according to claim 8, wherein said vessel further comprises a check valve preventing reverse flow from said conduit into said vessel.

12. A laser color printer, comprising:

a dye vessel for holding solid dye powder;

a heated conduit for receiving solid dye powder from said dye vessel and heating said solid dye powder to a liquid state, creating liquid dye;

a liquid dye holder arranged to receive and hold liquid dye from said heated conduit, said liquid dye holder having a reticulate structure for holding an amount of liquid dye for printing;

a light-heat converter arranged on said liquid dye holder;

a laser arranged above said light-heat converter and arranged for directing laser light onto said light-heat converter for causing heat from said converter to vaporize selected regions of said liquid dye held by said dye holder, creating vaporized dye; and a platform for holding a sheet of paper adjacent said liquid die holder across a gap, arranged for said vaporized dye to impinge said sheet of paper for printing.

13. The printer according to claim 12, further comprising a light transmitting base arranged in lamination with said light-heat converter and said dye holder.

14. The printer according to claim 12, wherein said heated dye conduit further comprises a vibrator for assisting translation of said dye through said conduit.

15. The printer according to claim 14, wherein said vessel further comprises a check valve preventing reverse flow from said conduit into said vessel.

* * * * *